United States Patent [19]

Travis

[11] 4,444,323

[45] Apr. 24, 1984

[54] RETAINING MEANS FOR ADJUSTABLE CANTILEVER STORAGE RACKS

[75] Inventor: Merton A. Travis, Shingle Springs, Calif.

[73] Assignee: Travis Handling Systems, Inc., Shingle Springs, Calif.

[21] Appl. No.: 262,445

[22] Filed: May 11, 1981

[51] Int. Cl.[3] ..... A47B 47/00

[52] U.S. Cl. ..... 211/193; 108/108; 108/110; 211/208; 248/243

[58] Field of Search ..... 211/187, 192, 193, 191, 211/208; 108/107, 108, 110; 248/243

[56] References Cited

U.S. PATENT DOCUMENTS

| | | | |
|---|---|---|---|
| 2,729,342 | 1/1956 | Saul, Jr. | 211/191 |
| 2,925,920 | 2/1960 | Skubic | 211/191 |
| 2,984,363 | 5/1961 | Lang et al. | 211/191 X |
| 3,120,200 | 2/1964 | Travis | 108/107 |
| 3,273,720 | 9/1966 | Seiz | 211/192 |
| 3,347,187 | 10/1967 | Khoury | 108/108 |
| 3,414,224 | 12/1968 | Robilliard et al. | 211/192 X |
| 3,550,785 | 12/1970 | Seiz | 108/108 X |
| 3,697,034 | 10/1972 | Shell | 248/243 |
| 3,794,183 | 2/1974 | Colbridge | 211/208 |

*Primary Examiner*—J. Franklin Foss
*Assistant Examiner*—David L. Talbott
*Attorney, Agent, or Firm*—Fulwider, Patton, Rieber, Lee & Utecht

[57] ABSTRACT

For use in adjustable cantilever rack systems having upright support columns connected to brackets having cantilever arms, a retaining means is provided for securing the bracket to a column member against accidental disconnection, said retaining means including a retaining pin arranged to fit within an aperture located substantially on the neutral axis of a load bearing surface of the column to restrict upward movement of the bracket relative to the column and prevent accidental disengagement caused by upwards, sideways or oblique torsional blows. The retaining pin can be resiliently biased by a flat spring to snap into place once the bracket and column are connected, and the retaining means can also be provided with a thumb latch to provide simple disengagement.

8 Claims, 5 Drawing Figures

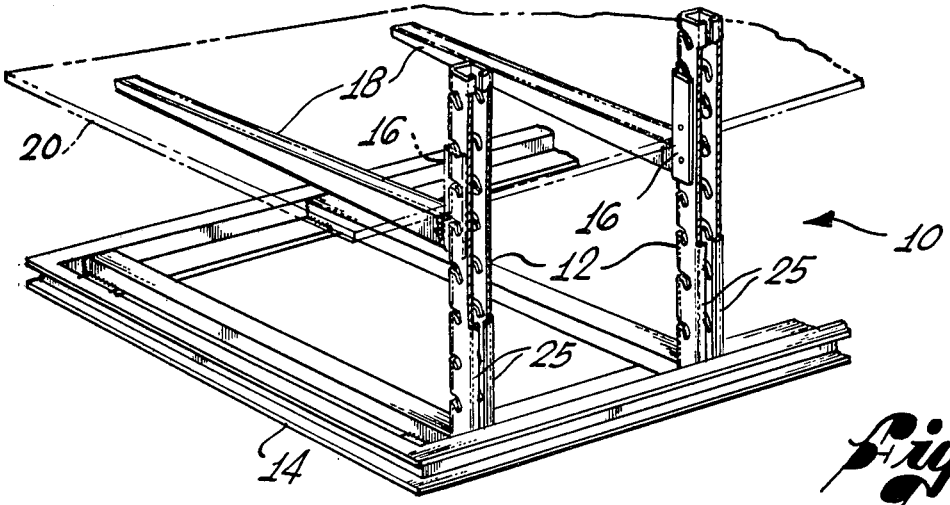
Fig. 1
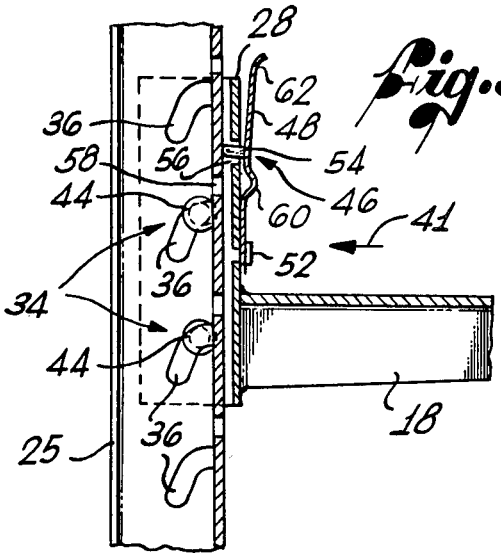
Fig. 3
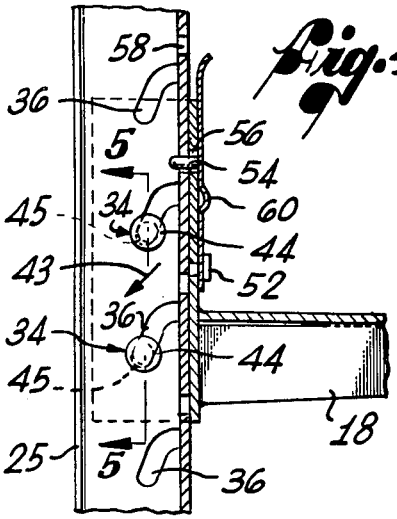
Fig. 4
Fig. 2
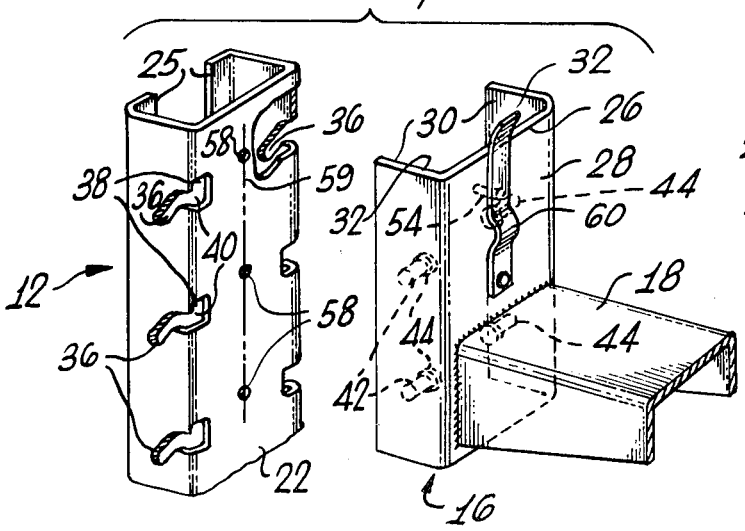
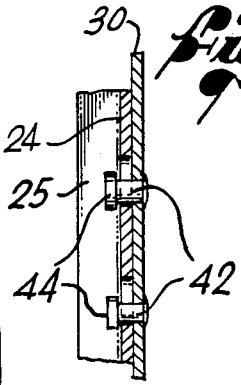
Fig. 5

RETAINING MEANS FOR ADJUSTABLE CANTILEVER STORAGE RACKS

BACKGROUND OF THE INVENTION

This invention relates generally to adjustable storage racks, and more particularly, to connecting means specially adapted for cantilever storage racks.

Adjustable racks with unobstructed multilevel shelving capabilities have found utility in a variety of commercial enterprises, but especially in those where storage requirements constantly vary, due to changes in the quantity or size of items stored. Indeed, the ability to respond rapidly and cheaply to fluctuating storage needs, by increasing storage space or just rearranging the existing spaces, is often crucial to an enterprise's successful operation.

Various storage rack systems, including cantilever structures, that are easy to rearrange, assemble and disassemble, either manually or using mechanical means (e.g., a forklift), have been known for a number of years. And by way of example, several forms of such systems may be found in U.S. Pat. Nos. 2,729,342, 2,925,920, 2,984,363 and 3,120,200.

Although cantilever systems with shelves fulfill most of the above-noted requirements for acceptable storage racks, experience with such structures has been less than satisfactory, primarily because of their inability to withstand the jostling frequently encountered during everyday use. Specifically, inadvertent strong collisions with the storage rack, such as jolts generated by careless use of forklifts and other machinery, often induce disengagement of the connecting assembly between rack components. Once the connecting assembly disengages, the shelves relying on the assembly for support, as well as any stored items sitting on the shelves, will fall.

In addition to the clear risk the falling shelves and stored items pose to human safety, the stored items themselves could be severely damaged or completely ruined. Further, rebuilding the storage system entails significant economic hardship, including substantial wasted personnel time and lost access to the entire storage area during the rebuilding period.

Thus, there exists a pronounced need for an improved cantilever storage rack system that effectively negates the effect accidental jostling has on the storage rack connecting assembly. The present invention fulfills this need.

SUMMARY OF THE INVENTION

The present invention provides a retaining mechanism for storage rack connecting assemblies that substantially improves the stability of adjustable storage racks, particularly cantilever storage racks, and that significantly reduces the likelihood that inadvertent jostling of the racks will cause disengagement of the connecting assembly. Moreover, the novel construction of the present invention is relatively inexpensive to manufacture, is trouble-free and reliable in use, and is functional without unduly hampering or complicating rearrangement, assembly or disassembly of the racks.

A common cantilever rack structure comprises an upright support member and a slightly larger bracket having a cantilever arm, the bracket being shaped such that the support member and the bracket fit together. The bracket and support member connect together by a connecting assembly, e.g., one or more pins on the bracket that engage one or more bayonet slots in the support member. The structure supports weight, at least in-part, by contact between the bracket and a primary load bearing surface of the support member.

The present invention resides in a novel retaining means for counteracting forces tending to disconnect the bracket from the support member. The retaining means applies a retaining force centered substantially along a neutral axis of the load bearing surface of the support member in response to upwards, sideways or oblique blows on the cantilever arm.

More specifically, a presently preferred embodiment of the invention includes a retaining pin arranged to fit within an aperture located substantially on the neutral axis of the load bearing surface of a support channel member to restrict upward movement of the bracket relative to the support member, and thus, inhibit accidental disengagement of the connecting assembly. As illustrated herein, the bracket also has an aperture that aligns with the aperture in the channel member when the bracket and channel member are connected, allowing the retaining pin to be arranged to fit within both apertures and thus providing increased stability to the cantilever rack structure.

In an additional feature of the present invention, to facilitate fitting the retaining pin in the apertures after the bracket and channel member have been connected, the retaining pin is preferably resiliently biased to snap into place after the connection has been completed. The resilient bias may be provided by a flat spring.

For convenience in disconnecting the bracket from the channel member, the retaining pin can be designed to permit manual removal from the aperture. Specifically, a flat spring can be shaped to form a top thumb latch or other shape capable of accepting a lever, such as screw driver, to exert sufficient force against the resilient bias of the spring for simple removal of the retaining pin from any apertures. This, in turn, allows easy disconnection of the bracket from the channel member.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 1 is a perspective view of the cantilever storage rack system of the present invention with the outer flanges of the support member shown partly broken away;

FIG. 2 is an enlarged, fragmentary perspective view of the bracket and column of the present invention shown in an exploded position, with parts of the bracket and retaining means shown in phantom line, and part of the column member broken away to show details thereof;

FIG. 3 is an enlarged, fragmentary cross-sectional view of the bracket and column, with the connecting assembly and retaining means shown in a partially assembled position and a portion of the bracket shown in phantom;

FIG. 4 is an enlarged, fragmentary cross-sectional view, similar to the view of FIG. 2, but showing the bracket and column in their fully connected position; and FIG. 5 is an enlarged, fragmentary partly sectional view taken substantially along the line 5—5 in FIG. 4.

DETAILED DESCRIPTION

As shown in the drawings for purposes of illustration, the present invention is embodied in an adjustable cantilever storage rack system, indicated generally by reference numeral 10 in FIG. 1. In this instance, a pair of support column members 12 are mounted on a frame 14 for stability.. Connected to the columns 12, are brackets 16, each having a cantilever arm 18 for accepting a shelf 20 to provide storage space. In cantilever storage rack systems, it is highly desirable to prevent any brackets having cantilever arms from becoming disconnected from their supporting column members, so that any shelves sitting on the cantilever arms will not lose support and fall.

The detailed construction of the bracket 16 and column member 12 is best illustrated in FIG. 2, wherein the channel member 12 has a front wall 22, two parallel side walls 24, generally perpendicular to the front wall 22, and two outer flanges 25 extending from the side walls and generally parallel to the front wall. The bracket 16 is slightly larger than, but shaped to fit with, the channel member 12. The bracket 16 has a vertical front wall 26 with a front face 28 and two side walls 30, each having an inside face 32. A cantilever arm 18 projects generally perpendicularly from the front face 28 and generally away from the side walls 30 of the bracket 16.

To connect the bracket 16 with the channel member 12, a connecting assembly means, indicated generally by reference numeral 34 in FIGS. 3 and 4, is provided. The connecting means 34 comprises transversely aligned, vertically-spaced pairs of bayonet slots 36 formed in the side walls 24 of the channel member 12 and elongated portals 38 formed in the front wall 22 of the channel member and opening into an upper portion 40 of the bayonet slots 36. The connecting means 34 also comprises transversely aligned, vertically-spaced pairs of inwardly directed pins 42 located on the inside face 32 of the bracket side walls 30.

For fully connecting the bracket 16 with the channel member 12, the pins 42, which preferably have heads 44, move in the direction of arrow 41 in FIG. 3 through the portals 38 and pass through the upper portion 40 of the bayonet slots 36, and then downward in the direction of arrow 43 in FIG. 4 to engage the bayonet slots 36. As illustrated in FIG. 4, the pins 42 do not have to completely sit in the bottom portion 45 of the bayonet slots 36, although if a substantial downward force were applied to the cantilever arm 18, the pins could become completely seated. Weight placed on the cantilever arm 18 will be borne in part by the pins 42 and the engaged bayonet slots 36, but a more significant amount will also be borne by the area of contact between the bracket 16 and the column member 12. The front wall 22 of the column member 12 is, thus, a primary load bearing surface of the column member.

In accordance with the present invention, a retaining means is provided for restricting relative upward movement of the bracket 16 with respect to the channel member 12, after the bracket and channel member have been connected. In this instance, a retaining means, generally designated by reference numeral 46 in FIG. 3, is fastened to the bracket 16, so that when the bracket is connected with the channel member 12, accidental disengagement of the connecting means is prevented, dramatically improving the safety of the entire storage rack system 10.

As best shown in FIGS. 2—4, the retaining means 46 comprises a generally flat spring 48 attached at one end thereof to the front face 28 of the bracket 16 by any suitable means such as a rivet 52. The spring 48 includes a retaining pin 54, which is arranged to fit within an aperture 56 in the front wall 26 of the bracket 16. An aperture 58 is also provided in the front wall 22 of the channel member 12, so that when the bracket 16 and the channel member 12 are connected, the aperture 56 of the bracket 16 and the aperture 58 of the channel member 12 align to accept the retaining pin 54.

For maximum protection against accidental disconnection of the bracket 16 from the channel member 12, the aperture 58 is located symmetrically about a neutral axis of a primary load bearing surface of the channel member. The neutral axis, which is generally indicated by reference line 59 in FIG. 2, lies along the central longitudinal axis of the front wall 22 of the channel member 12. When the retaining pin 54 is securely fitted within the aperture 58 located along the neutral axis 59, upwards, sideways or oblique torsional blows are unlikely to induce disconnection of the bracket 16 from the channel member.

When the retaining pin 54 is located along the neutral axis 59 of a primary load bearing surface of the channel member 12, it can act in conjunction with the headed pins 44 of the channel member to further stabilize the system against accidental jostling. In the preferred embodiment of the invention illustrated herein, the headed pins 44 and the retaining pin 54 are in a triangular configuration, which tends to spread out and, thus, balance disruptive forces throughout the entire connecting assembly. Moreover, the heads 44 of the pins 42 on the column member restrain the side walls 30 from spreading in response to blows on the cantilever arm, which in turn ensures against dislodgement of the centrally aligned retaining pin 54 from its aperture 58.

Alternatively, multiple apertures in conjunction with multiple retaining pins can be utilized. The apertures can be arranged substantially symmetrically about the neutral axis of the load bearing surface, or in such a manner that when the retaining pins are fitted within their corresponding apertures, they provide a retaining force centered substantially along a neutral axis of the load bearing surface of the channel member in response to forces tending to disconnect the bracket from the support member.

The operation of the retaining means 40 is best seen in FIGS. 3 and 4. In FIG. 3, the bracket 16 is shown partially connected with the column member 12, and the pins 42 are seated in the upper portion 40 of the bayonet slots 36. The retaining pin 54 is contacting the front wall 22 of the channel member 12, which causes the resilient spring 48 to bend away from the front wall 26 of the bracket 16. Because the spring 48 is attached at its lower end to the front wall 24 of the bracket 16, the restraining pin 54 is resiliently biased and bears against the front wall 22 of the channel member 12. As shown in FIG. 4, when the pins 42 engage the bayonet slots 36, fully connecting the bracket 16 with the channel member 12, the restraining pin 54 has snapped into the aperture 58 in the front wall 22 of the channel member. With the retaining pin 54 securely placed within the aperture 58, relative upward movement of the entire bracket 16 with respect to the channel member 12 is restricted, and the likelihood of accidental disengagement of the connecting means 34 is substantially reduced.

In order to provide convenient separation of the bracket 16 from the channel member 12, the spring 48 is formed with an arched portion 60 adjacent the pin 54 capable of accepting a lever, such as a screwdriver, to exert sufficient force against the resilient bias of the spring for removal of the retaining pin 56 from the aperture 58 in the front wall 22 of the channel member 12. The bracket 16 can then be simply lifted up and away from the channel member 12. To further facilitate removal of the retaining pin 54 from the aperture 58, the spring 48 may also include a thumb latch 62 at its upper end to permit manual disengagement of the retaining means 46.

From the foregoing, it will be appreciated that the retaining means 46 of the present invention provides protection against accidental disconnection of the bracket 16, which preferably has a cantilever arm 18, from an upright support column member 12, when the cantilever arm or bracket is subjected to upwards, sideways or oblique torsional blows. Further, the retaining means 46 can be fabricated economically from readily available parts and can be conveniently installed in existing cantilever rack systems, without substantially modifying the rack structure components or unduly complicating assembly or diassembly of the racks.

It will also be appreciated that, although a particular embodiment of the invention has been described in detail for purposes of illustration, various modifications may be made without departing from the spirit and scope of the invention. Accordingly, the invention is not to be limited, except as by the appended claims.

I claim:

1. An adjustable cantilever storage rack comprising:
an upright, channel member having a vertical front wall and two parallel side walls generally perpendicular to the front wall, at least one of said walls being a primary load bearing surface;
a bracket having a vertical front wall and two side walls, and shaped such that said channel member and said bracket fit together;
a cantilever arm projecting generally away from the walls of said bracket;
connecting means for connecting said channel member with said bracket, said connecting means comprising an inclined bayonet slot formed in a wall of said channel member and inclined downwardly and away from said primary load bearing surface, an elongated portal formed in a wall of said channel member and opening into the upper portion of the bayonet slot, and an inwardly directed pin on the inside of a bracket wall, said pin drawing said bracket against said primary load bearing surface of said channel member as said pin engages said inclined bayonet slot, whereby a downward force on said bracket causes said pin to move downwardly and away from said primary load bearing surface to cause said bracket to engage said primary load bearing surface;
retaining means comprising a retaining pin arranged to fit within an aperature located in a wall different from that having said inclined bayonet slot and substantially on a neutral axis of said load bearing surface of said channel member for restricting upward movement of said bracket relative to said channel member, said connecting means and said retaining means cooperating to rigidly support said cantilever arm on said channel member, whereby the likelihood of accidental disengagement of the connecting means by upwards, sideways or oblique torsional blows on the cantilever arm is substantially reduced.

2. The cantilever storage rack as defined in claim 1 wherein said bracket contains an aperture that aligns with the aperture in said channel member when said bracket and said channel member are connected, and wherein said retaining pin is arranged to fit within both apertures.

3. The cantilever storage rack as defined in claim 1 wherein said retaining pin is resiliently biased to fit within said aperture in said channel member when said bracket is connected to said channel member.

4. The cantilever storage rack as defined in claim 3 wherein said retaining means further includes means for removing said retaining pin from said aperture against the force of the resilient bias to permit disconnection of said bracket from said channel member.

5. The cantilever storage rack as defined in claim 4 wherein said resilient bias is provided by a flat spring.

6. The cantilever storage rack as defined in claim 5 wherein said flat spring is shaped to form a top thumb latch to facilitate removal of said retaining pin from said aperture.

7. The storage rack of claim 1, wherein said connecting means further includes a second inclined bayonet slot formed in a second wall of said channel member and a second inwardly directed pin on the inside of a second bracket wall, and wherein both of said pins are headed to restrain spreading of said sidewalls of said bracket by contacting the inner walls of said channel member when said pins are engaged into said bayonet slots, and when said cantilever arm is impacted by a sideways blow.

8. An adjustable cantilever storage rack comprising:
an upright, channel member having a vertical front wall and two parallel side walls generally perpendicular to the front wall;
a bracket having a vertical front wall and two side walls and shaped such that said channel member and said bracket fit together;
a cantilever arm projecting generally perpendicularly from the front wall of said bracket and directed away from said bracket side walls;
connecting means for connecting said channel member with said bracket, said connecting means comprising transversely aligned vertically-spaced pairs of bayonet slots formed in the side walls of said channel member, said bayonet slots being inclined downwardly and away from the front wall of said channel member, elongated portals formed in the front wall of said channel member and opening into the upper protion of the bayonet slots, and a pair of inwardly directed headed pins on the inside of the bracket side walls that are adapted to move through said portals and engage into said bayonet slots to draw said front wall of said bracket into engagement with said front wall of said channel member to fully connect said bracket and said channel member, whereby said front wall of said channel member becomes a primary load-bearing surface for said cantilever storage rack;
retaining means comprising a flat spring fastened to the back of the front wall of said bracket and having a retaining pin, an aperture in the front wall of said bracket, and an aperture located substantially along the neutral axis of said channel member front wall, wherein the apertures align to accept said retaining pin when said bracket and said channel member are connected with their respective front walls in engagement thereby to restrict relative upward movement between said bracket and said channel member, said connecting means and said retaining means forming a triangular support for rigidly supporting said arm on said channel member, thereby preventing accidental disengagement of the connecting means by upwards, sideways or oblique torsional blows.

* * * * *